US005243914A

United States Patent [19]

Penner

[11] Patent Number: 5,243,914

[45] Date of Patent: Sep. 14, 1993

[54] CASELESS AMMUNITION

[75] Inventor: Horst Penner, Furth/Bayern, Fed. Rep. of Germany

[73] Assignee: Dynamit Nobel Aktiengesellschaft, Troisdorf, Fed. Rep. of Germany

[21] Appl. No.: 915,212

[22] Filed: Sep. 30, 1986

[30] Foreign Application Priority Data

Oct. 1, 1985 [DE] Fed. Rep. of Germany ..... 3534972

[51] Int. Cl.[5] ..... F42B 1/02; C06D 1/08

[52] U.S. Cl. ..... 102/307; 102/309; 102/431; 102/432; 86/20.12

[58] Field of Search ..... 102/306–310, 102/476, 431–433; 86/20, 12

[56] References Cited

U.S. PATENT DOCUMENTS

| | | | |
|---|---|---|---|
| 3,293,056 | 12/1966 | Baker | 106/77 |
| 3,397,637 | 8/1968 | Bobinski et al. | 102/38 |
| 4,519,313 | 5/1985 | Leidel | 102/307 X |
| 4,543,703 | 10/1985 | Wetzel et al. | 102/310 X |
| 4,643,097 | 2/1987 | Chawla | 102/476 X |

FOREIGN PATENT DOCUMENTS

| | | |
|---|---|---|
| 2424900 | 5/1974 | Fed. Rep. of Germany . |
| 2843477 | 10/1978 | Fed. Rep. of Germany . |
| 364126 | 6/1930 | United Kingdom . |
| 949111 | 1/1961 | United Kingdom . |
| 1193134 | 11/1967 | United Kingdom . |
| 1211658 | 4/1969 | United Kingdom . |
| 1337340 | 6/1971 | United Kingdom . |
| 1490511 | 4/1972 | United Kingdom . |

*Primary Examiner*—Peter A. Nelson

*Attorney, Agent, or Firm*—Antonelli, Terry, Stout & Kraus

[57] ABSTRACT

This invention deals with case-less ammunition, the propelling element of which has increased solidity. This increase in solidity is achieved by virtue of the fact that the propelling charge is firmly enveloped in a fabric. The fabric may consist of completely synthetic organic fibers or of mineral bibers. The ammunition in accordance with the invention manifests increased stability during loading and transportation in the weapon and better internal ballistics data than comparable ammunition known to date on the basis of the higher tamping attained.

11 Claims, 1 Drawing Sheet

CASELESS AMMUNITION

The invention involves case-less ammunition of the type designated in the specification of Patent claim 1, the propelling charge of which has increased solidity, and a process for the manufacture of this ammunition.

In developing ammunition with a case-less propelling charge, ensuring adequate solidity of the propelling charge is decisive. There are known case-less propelling charges made of powdery propellants, which are bound with the aid of polymer binders and fibers (DE-OS 28 43 477).

In the manufacture of these propelling charges the propellant, which is in powder and/or crystalline form, is mixed with the binder and fiber segments, which have a length up to about 20 mm, and homogenized at a time when the substance is still soft. In such a process an irregular positioning of the added fiber segments results, and there is no possibility of controlling their position effectively and thereby the direction of increasing the solidity—even during longer mixing times.

In general such propelling charges, which contain fibers in disarry, do not have a solidity that is adequate or can be adjusted in a reproducible manner. At the same time this has the effect that the stamping often is incapable of sufficient resistance not only against external forces but also against the self-destruction charge. Hence the stamping in some cases cannot exert enough resistance against the pressure of the self-destruction charge, so that its operation in accordance with its purpose is jeopardized.

Therefore there existed the problem of making available case-less ammunition with increased mechanical stability and satisfactory internal ballistic characteristics.

In accordance with the present invention this problem is solved by virtue of the fact that the characteristics of Patent claim 1 are realized in case-less ammunition of the type that was initially indicated.

Through this a substantial increase in solidity and an improvement in the ballistic characteristics of the case-less ammunition are achieved. At the same time the manufacturing process for the propellant is simplified to the extent that the kneading process for the propellant raw material is not disturbed by the added fiber segments or excessively lengthened.

The propelling charges enveloped in the reinforcing fabric are in general firmly connected with the projectile and compressed to a compact block through a pressing process. With regard to the so-called "telescope cartridges," however, the projectile may lie loose in the propelling charge. It is then held in the propelling charge by additional fastening elements. This kind of ammunition is generally ignited by a percussion cap in the rear part of the propelling charge and fragmented by means of a self-destruction charge located in the interior of the propellant block. The propellant pressing in accordance with the invention is not only capable of resisting external forces but also exhibits a certain resistance against the pressure of the self-destruction charge, i. e. a certain tamping effect, so that the ammunition can function as it is intended to.

A local increase in solidity on the surfaces of the propelling charge, which are especially subject to mechanical strains, is attained through the application of a reinforcing fabric.

Through the design in accordance with the invention the solidity of the pressing's surface is increased, so that separation and crumbling of pieces of the propellant can be avoided with assurance when ammunition is being put into the magazine or being loaded into the weapon or in the equipment, especially through the operation of the follower, which strikes the ammunition with high velocity, and further through the impact of the ammunition in the cartridge chamber and also through the effect of other transport and handling processes.

Through the design in accordance with the invention of the propelling element the tamping of the self-destruction charge is substantially increased. This is especially the case for brittle propellants, which normally can exert a tamping effect only for a short time because of the very rapid self-destruction process.

Because of the reinforcing fabric the dispersion of the propellant fragments flying around in the self-destruction process is reduced. A disturbance of the obturation of the cartridge chamber closure through scattered propellant particles is thereby largely prevented or at least greatly reduced.

The preferred materials for the reinforcement fabric are threads made of polyamide, polyesters, polyacrylnitrile, polypropylene and also natural fibers such as cellulose, silk, hemp, sisal or jute, Examples of polyamide yarns include the various kinds of nylon yarns. Yarns made from polyesters refer primarily to those made from a material that is obtained through the condensation of aromatic dicarbonic acids, mainly terephthalic acid or its ester, with dioles. Reinforcement fabric made out of mineral or metallic threads using glass, quartz, carbon, aluminum, magnesium, boron, aluminum oxide and similar materials come into consideration for the purpose in mind, namely, whenever an especially large increase in solidity must be attained and complete flammability or vaporizability is not required.

The yarns used for the fabric naturally must have a certain strength, but they can also be elastic. Fabric made of elastic yarns is used especially when an improvement in tamping is desired, because the fragments of exploding propellant blocks are held together relatively longer with fabrics made of elastic yarns.

The reinforcement fabric is constructed through weaving, knitting, netting or similar known techniques, preferably from endless monofilament or plied strands. In this regard the plied strands can be either parallel or twisted. Particularly for short-fibered natural products twisted (twined) threads may be used. The strength as well as the elasticity of the fabric to be used can thus be adapted precisely for the requirements in each case.

The mesh sizes of the reinforcement fabric are determined, among other things, by the caliber of the case-less ammunition. For small caliber ammunition mesh sizes up to about 1 mm have proven to be suitable. For ammunition of larger caliber the mesh sizes can be increased correspondingly. In general the mesh size of the fabric is equal to a tenth of the ammunition caliber at the most.

The propelling element is coated with the reinforcement fabric through pressing, gluing, shrinking, rolling, welding, compressing or stamping. The application can take place before the molding of the propelling element, especially when the molding of the element takes place through the pressing of a still soft blank. It is also possible, however, to glue, shrink, roll or weld the fabric to the prefabricated propelling element. The selection of the method suitable for coating and binding the propelling element firmly with the reinforcement fabric depends on a number of factors, including the geometric shape of the ammunition, the kind of propellant and the type or design of the reinforcement fabric and is made through an expert assessment of these factors. In this regard it is also possible in accordance with the invention not to cover the whole available surface with the fabric; it is sufficient in some cases to cover only the major portion of the surface of the propelling element with the fabric. The surface of the propelling element in this respect is understood to mean that part of the total surface of the propelling element that is not firmly connected with other parts of the ammunition such as the projectile, for example.

The covering of the propelling element with fabric in accordance with the invention is carried out preferably on propelling elements that disintegrate easily, especially because of a small proportion of binder and a high proportion of powdery propellant. In general, however, the composition of the propelling element is of no consequence in the covering in accordance with the invention, since practically all known propelling elements that are used in case-less ammunition can be covered in accordance with the invention.

EXAMPLE OF APPLICATION

Figure 1:
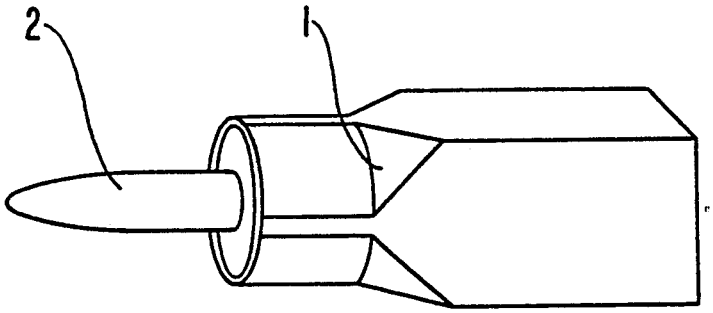
FIG. 1 a round of case-less ammunition is portrayed in accordance with the known level of technology.
Figure 2:
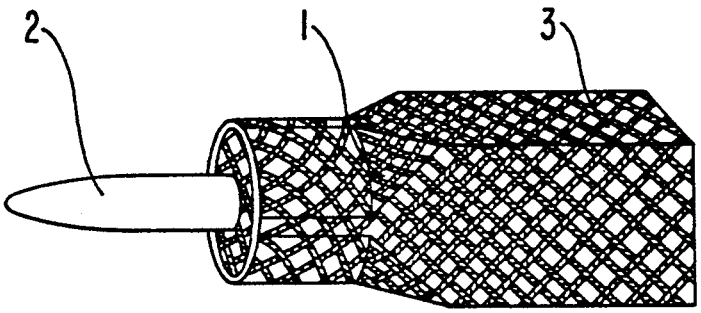
FIG. 2 portrays a possible embodiment in accordance with the present invention. In the FIGS. 1 indicates the propelling element, 2 the projectile connected to it and 3 the fabric.
Figure 3:
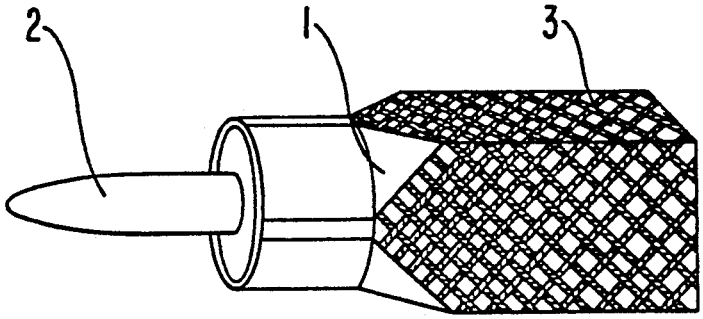
FIG. 3 portrays a further possible embodiment in which the whole propelling element is not covered in accordance with the invention but rather only the major portion of this element.

Testing of the present invention took place using case-less cartridges with a caliber of 4.7 mm. With this an extruded propellant cord was covered with a tube made of silk gauze. The silk gauze had a surface weight of 0.05 kg/m$^2$ and a mesh number of 15 meshes per centimeter. In addition the propellant cord was cut in pieces of the proper shape, placed in a compression molding machine together with the projectile and pressed to make a cartridge. After this the fabric tube was bound firmly to the propellant pressing. The subsequent fabrication to make a finished cartridge took place in the usual manner through installation of the ignition train and application of the surface protection.

In the following table the mechanical stability and internal ballistics characteristics of the cartridges manufactured in this manner are listed in comparison with those for cartridges in which the fiber portion was distributed evenly in the molding in accordance with the process described in DE-OS 28 43 477 or for those that had no fibers added.

| | Type of cartridge | | |
|---|---|---|---|
| | Without fiber added fiber added | With 4% fiber added in the compound | With 4% fiber added as a segment of a fabric tube |
| Impact resistance (N · cm) | 27 | 56 | 64.8 |
| Gas pressure in gas pressure gauge (bar) | 3,913 | 3,665 | 4,317 |
| Projectile muzzle velocity (m/s) | 867 | 852 | 864 |

In addition cartridges that were fed into the weapon without firing showed clearly that the follower caused considerable crumbling of the propelling element in cartridges to which fibers had not been added. In cartridges in which fiber had been added to the compound this crumbling was observed only seldom, while in cartridges of the kind made in accordance with the invention no crumbling occurred.

I claim:

1. Case-less ammunition consisting of a propelling charge and a projectile connected to it, characterized by the fact that the propelling charge is enveloped by a fabric made of flammable or vaporizable materials.

2. Ammunition in accordance with claim 1, characterized by the fact that the fabric is constructed through weaving, knitting, netting or similar processes out of monofilament or parallel or twisted plied threads made from synthetic, natural or inorganic materials.

3. Ammunition in accordance with claim 1, characterized by the fact that the mesh size of the fabric corresponds to a tenth of the ammunition caliber at the most.

4. A process for manufacturing case-less ammunition which comprises wrapping a fabric around a propelling charge, subjecting the wrapped propelling charge to a pressing operation to provide a final shape to the propelling charge and, thereafter, joining the wrapped and shaped propelling charge with a projectile.

5. A process according to claim 4, wherein said fabric has an open mesh construction and is wrapped in direct contact with the propelling charge.

6. A process for manufacturing case-less ammunition which comprises wrapped a fabric around a propelling charge joined with a projectile and, thereafter, subjecting the propelling charge wrapped in the fabric to a pressing operation to provide the propelling charge with a final shape.

7. A process according to claim 6, wherein said fabric has an open mesh construction and is wrapped in direct contact with the propelling charge.

8. A case-less ammunition which comprises a propelling charge and a projectile connected to said propelling charge, said propelling charge being enveloped by an in direct contact with a fabric.

9. The ammunition according to claim 8, wherein said fabric is made of a flammable material.

10. The ammunition according to claim 8, wherein the fabric is made of a vaporizable material.

11. The ammunition according to claim 8, wherein the fabric is made from a synthetic, natural or inorganic material and has an open mesh construction.

* * * * *